US005317790A

United States Patent [19]

Plaschy

[11] Patent Number: 5,317,790

[45] Date of Patent: Jun. 7, 1994

[54] CLAMPING DEVICE FOR A PLANE THREAD LAYER AND USE OF SAID DEVICE

[75] Inventor: Martin Plaschy, Hombrechtikon, Switzerland

[73] Assignee: Zellweger Uster AG, Uster, Switzerland

[21] Appl. No.: 965,398

[22] PCT Filed: Apr. 21, 1992

[86] PCT No.: PCT/CH92/00073

§ 371 Date: Dec. 18, 1992

§ 102(e) Date: Dec. 18, 1992

[87] PCT Pub. No.: WO92/18676

PCT Pub. Date: Oct. 29, 1992

[30] Foreign Application Priority Data

Apr. 22, 1991 [CH] Switzerland ..... 01 193/91-1

[51] Int. Cl.[5] ..... D03J 1/16

[52] U.S. Cl. ..... 28/209; 28/208; 28/212; 269/49; 269/54.3

[58] Field of Search ..... 28/201, 202, 204, 208, 28/209, 212; 269/49, 54.3, 152

[56] References Cited

U.S. PATENT DOCUMENTS 938,130 10/1909 Dorr ..... 28/208
991,640 5/1911 Peterson ..... 28/208 X
1,079,470 11/1913 Colman ..... 28/212 X
1,479,962 1/1924 Hand et al. ..... 269/54.3
2,482,155 9/1949 Crandall ..... 28/209 X
4,175,734 11/1979 Williams ..... 269/49
5,109,582 5/1992 Okuda ..... 28/208

*Primary Examiner*—Clifford D. Crowder
*Assistant Examiner*—John J. Calvert
*Attorney, Agent, or Firm*—Burns, Doane, Swecker & Mathis

[57] ABSTRACT

A clamping device for a planer layer of threads includes a clamping rail adapted to extend across the layer of threads and provided with a contact zone for contacting one face of the thread layer, and a plurality of clamping member units spaced along the length of the clamping rail. Each of the clamping member units includes a support element having a pivot axis and mounted for pivoting movement about the pivot axis and linear movement along the axis, and a thread contacting member carried by the end portion of the supporting member. When the support element is pivoted about the pivot axis, the thread contacting member swings from a first position at right angles to the contact zone of the clamping rail to a second position parallel to the contact zone. When the support element is moved in the linear direction, the thread contacting member moves closer to or farther from the clamping rail.

10 Claims, 1 Drawing Sheet

CLAMPING DEVICE FOR A PLANE THREAD LAYER AND USE OF SAID DEVICE

Figure 1:
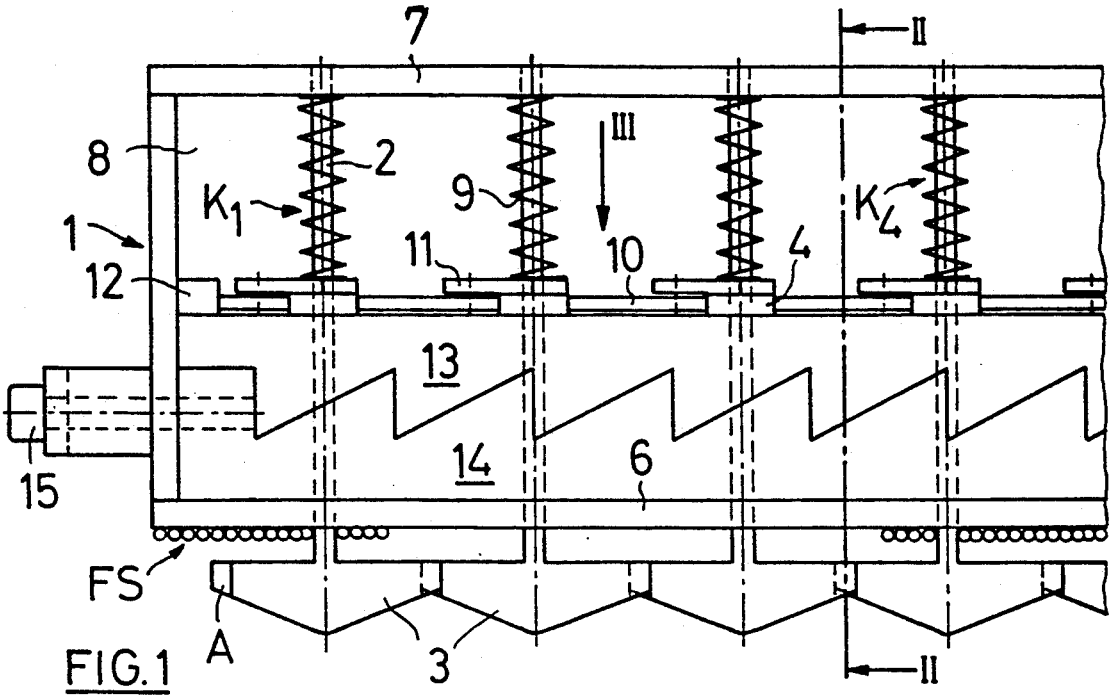

The present invention relates to a clamping device for a plane thread layer, having a fixed clamping rail and a clamping member which is adjustable relative to said clamping rail.

Such clamping devices are used, for example, in warp thread feed-in machines and in warp tying machines to clamp the warp threads. They generally comprise a clamping rail extending over the entire width of the warp and a rod-shaped clamping comb held in or on the clamping rail, said clamping comb being pressed from above into and then interlocked with the clamping rail. During the dismantling process after the tying operation, the clamping rail or the clamping comb has to be removed laterally after release of the clamp.

If said clamping device is to be used during the warp change in a power loom, then for spatial reasons alone lateral removal of the clamping comb and/or clamping rail is very awkward to arrange. Furthermore, the clamping rail would also have to be provided in a suitable manner at the clamping point, which would require either lateral insertion prior to clamping or a permanent arrangement on the power loom. The former has the drawbacks already mentioned with regard to the clamping comb and a permanent arrangement on the power loom would lead to unacceptable clogging of the clamping rail with dirt and dust. Moreover, a permanent arrangement of the clamping rail on the power loom would incur not inconsiderable additional costs.

Taking this train of thought one step further towards the idea of in some way automating the warp change or at least taking it some way towards automation, it becomes clear that such a development would be very much hampered by the known clamping devices because lateral insertion and removal of the clamping rail and/or clamping comb do not lend themselves at all well to automation.

The aim of the invention is therefore to indicate a clamping device of the type described initially, which is much easier to operate and also lends itself more to automation than the above-mentioned known devices.

Said aim is achieved according to the invention in that the clamping member comprises a plurality of adjacent clamping elements having a bow- or wing-like clamping part which is swing-adjustable between an insertion position into the thread layer and a clamping position for the thread layer.

The invention therefore proposes an, as it were, unilateral clamping device, i.e. one where only one side of the thread layer need be accessible. This, as distinct from the known clamping devices where clamping rail and clamping comb in their starting position are disposed at either side of the thread layer. Said unilateral clamping device comprises on the one hand a fixed clamping rail and on the other hand clamping elements which are supported on said clamping rail and are adjustable between two swivelling positions.

In the so-called insertion position, the clamping elements may be inserted from one side into the thread layer. When, after passing through the thread layer, they are swivelled into the clamping position, they then engage round the thread layer from the other side and form, together with the clamping rail, a clamping gap which is closed upon return movement of the clamping elements towards the clamping rail.

Since, in the clamping device according to the invention, only a single member has to be moved relative to the thread layer and said member may moreover be equipped relatively easily with the drive means required for the clamping process, the device is easier to operate and lends itself more to automation than the known clamping devices.

The invention further relates to a use of said clamping device for clamping a warp thread layer.

Said use is characterized by the following measures:

a. positioning of the clamping device at one side, above or below the thread layer;

b. movement of the clamping device, with the clamping elements of the clamping member in insertion position, towards the thread layer until the clamping elements pass through said thread layer;

c. adjustment of the clamping elements into their clamping position and return movement towards the clamping rail in order to close the clamping gap formed between clamping elements and clamping rail and embracing the thread layer at both sides.

Figure 2:
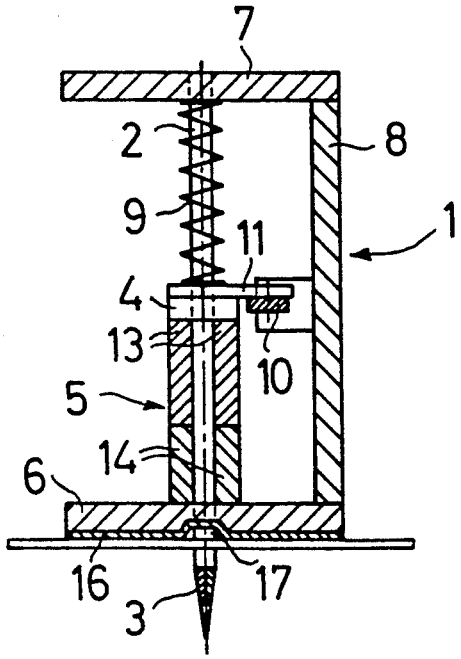

The invention is described in greater detail hereinafter with reference to an embodiment and the drawings; the drawings show:

FIG. 1 a cutout from a clamping device according to the invention for a warp thread layer, viewed in the direction of the warp threads;

FIG. 2 a section along the line II—II of FIG. 1; and

Figure 3:
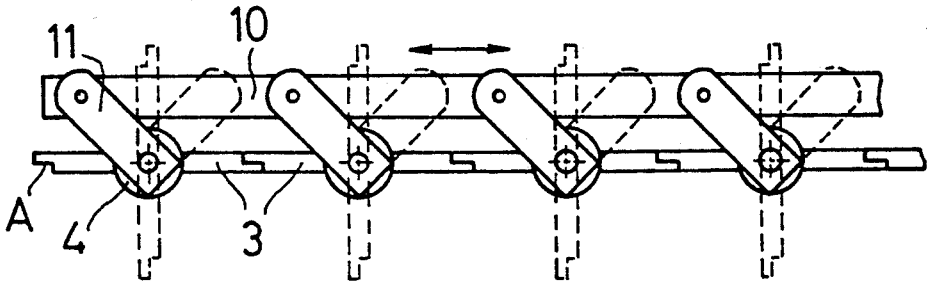

FIG. 3 a detail in the direction of the arrow III of FIG. 1.

FIGS. 1 and 2 show a front and a side view of a clamping device according to the invention which, as represented, comprises a clamping rail 1 and a clamping member formed by adjacent clamping elements K1 to Kn. The clamping device is used to clamp plane thread layers FS, in particular of warp threads and the like. The individual threads forming the thread layer FS extend, in FIG. 1, at right angles to the drawing plane and, in FIG. 2, horizontally, i.e. across the drawing sheet, and they are as a rule arranged closely adjacent to one another.

As already mentioned initially, the clamping device according to the invention is a "unilateral" device, in which the material to be clamped, i.e. the thread layer FS, need only be accessible from one side. In terms of FIGS. 1 and 2, said side is the top side of the thread layer FS; depending on spatial conditions, however, it may also be the bottom side or, in the case of a vertical thread layer, the left or right side or the back or front side. The important point is that the clamping device is positioned at said one side of the thread layer FS, so that the position of the clamping rail 1 is fixed at said one side. The clamping elements, which are movable relative to the clamping rail 1, then have to be brought to the other side of the thread layer FS to form a clamping gap, and finally the clamping gap has to be closed.

As represented, the clamping elements K1 to Kn substantially comprise a pin 2, which is supported stroke-displaceably on the clamping rail 1, one end of said pin projecting from the clamping rail 1 and carrying a wing-like clamping part 3. Said clamping part is formed by a relatively thin lamella, which is tapered both in length and in thickness towards its free end and which is approximately in the shape of an isosceles triangle carried at its base by the pin 2. The length of said base is greater than the distance between adjacent pins 2.

When the clamping device has been positioned at the one side of the thread layer FS and clamping is to be effected, the clamping parts 3 are aligned so as to extend parallel to the threads forming the thread layer FS; they are therefore rotated through 90° relative to the position shown in FIGS. 1 and 2. In said position, the clamping parts 3 have no difficulty in penetrating the thread layer FS. They are then swivelled back through 90° and assume the position shown in the drawings, in which they form a continuous clamping member and together with the clamping rail 1 delimit a clamping gap extending over the width of the thread layer FS.

The individual pins 2 are connected in the region of their central portion to a supporting ring or a supporting plate 4, by means of which they are supported on a retaining member 5 carried by the clamping rail 1. The clamping rail 1 has, in cross-section, a suitable shaping, e.g. a C-shaped profile with a bottom 6, a top wall 7 and a back wall 8. Pressure springs 9 act between the supporting rings 4 and the top wall 7 and press the supporting ring 4 towards the retaining member 5 and hence the clamping elements K1 to Kn in a downward direction.

As is revealed in particular in FIG. 3, which shows a detail in the direction of the arrow III of FIG. 1, the rotation or swivelling of the pins 2 and the clamping parts 3 is effected by a rod-like slide 10, which extends over the length of the clamping rail 1 and is hinged on adjusting arms 11 fastened to the individual pins 2. By means of stop elements 12 disposed in the clamping rail 1, the path of adjustment of the slide 10 is limited in such a way that the clamping parts 3 are swivelled between the two positions parallel and at right angles to the threads. In FIG. 3, the clamping position of the clamping elements K1 to Kn and of the adjusting arms 11 is illustrated by solid lines and the insertion position is illustrated by dashed lines.

Naturally, the described solution for the swivel drive of the pins 2 by means of slide 10 and adjusting arms 11 is only one embodiment. Another possibility consists of providing the supporting rings 4 at their periphery with a toothing and replacing the slide 10 with a toothed rack which meshes with said toothing. The construction of the clamping parts 3 is also to be regarded as exemplary. They could alternatively be formed by a bow of bent wire or the like.

Since, as already stated, the length of the clamping parts 3 at their base is greater than the spacing of the pins 2, the clamping parts 3 overlap one another in their clamping position by several millimeters. In order for the clamping member formed by the clamping parts 3 of the individual elements K1 to Kn to have as smooth as possible a surface with no laterally protruding edges or corners, the clamping parts are designed so as to be suitably graduated in their region of overlap. The graduations designated A are particularly evident in FIG. 3.

The retaining member 5 is formed, in each case, by two parallel toothed rack pairs disposed on either side along the pins 2 and comprising in each case a first and a second toothed rack 13 and 14. The first toothed racks 13, which serve as a support for the supporting rings 4 and hence for the clamping elements K1 to Kn, are flat at their supporting edge for the supporting rings 4 and have a toothing at their lower edge. They are moreover disposed in the clamping rail 1 in such a way that they may execute only a vertical movement.

The second toothed racks 14 similarly have a straight edge and an edge provided with a toothing. The straight edge serves as a supporting surface on the bottom 6 of the clamping rail 1, and the toothing at the other edge meshes with the toothing of the first toothed racks 13. The second toothed racks 14 are disposed in the clamping rail 1 in such a way that they may execute only a horizontal adjusting movement longitudinally of the clamping rail 1. Said adjustment is effected by suitable means, e.g. by means of a screw 15 (FIG. 1) acting between the clamping rail 1 and the second toothed racks 14 or by means of an eccentric, a toggle lever, hydraulic means or compressed air.

In the state shown in FIG. 1, the clamping gap is open and the clamping parts 3 are at their maximum distance from the clamping rail 1. To close the clamping gap and tightly clamp the thread layer FS, the screw 15 is then turned so that the second toothed racks 14 move to the left. As a result, the first toothed racks 13 and hence, via the supporting rings 4, the clamping elements K1 to Kn are raised against the action of the springs 9.

The clamping rail 1 is provided, at its supporting surface for the thread layer FS which co-forms the clamping gap, with an elastic support 16 made of a suitable material, e.g. rubber. To enhance the clamping effect, diversion of the thread at the clamping point may be effected, for which purpose the clamping rail 1 may have a groove 17 (FIG. 2) along the clamping line. In such a case, the support 16 could be omitted. A further variant would be to make said groove wider and deeper and provide it with an elastic insert.

The described unilateral clamping device may be used in particular for so-called warp dressing, i.e. for the drawing in and tying of warp threads, and is demonstrably superior to conventional bilateral clamping devices, especially in confined spatial conditions such as exist, for example, when installed in a power loom.

As the description of the clamping device reveals, its installation and operation require only a few manipulations, namely:

positioning on the thread layer FS in question
operation of the slide 10
operation of the screw 15.

Said manipulations may be easily automated, with the result that the clamping device according to the invention represents an important step towards the rationalization and automation of the process of drawing in and tying warp threads.

I claim:

1. A clamping device for a planar layer of threads comprising an elongated clamping rail adapted to extend across said layer of threads and being provided with a contact zone for contacting one face of said layer of threads, and a plurality of clamping member units spaced along the length of said elongated clamping rail;

each of said clamping member units including a support element having a pivot axis and being mounted for both pivoting about said pivot axis and linear bodily movement along said pivot axis, said support element having an end portion projecting through said contact zone on said clamping rail to a distal location spaced from said contact zone, and a thread contacting member carried by said end portion of said support element so that, when said support element is pivoted about said pivot axis, said thread contacting member swings from a first position at right angles to said contact zone to a second position parallel to said contact zone and so that, when said support element is moved bodily in a linear direction, said thread contacting member moves closer to or farther from said clamping rail.

2. A clamping device according to claim 1, wherein each thread contacting member includes a portion which overlaps a portion of an adjacent thread contacting member when the thread contacting members are in the second position.

3. A clamping device according to claim 2, wherein each thread contacting member includes a base having a thickness that is greater than a distance between adjacent support elements.

4. A clamping device according to claim 1, wherein each thread contacting member is configured such that a gap is formed between adjacent thread contacting members when the thread contacting members are in the first position and such that adjacent thread contacting members overlap one another when the thread contacting members are in the second position.

5. A clamping device according to claim 2, wherein the overlapping portions of the thread contacting members have a reduced thickness.

6. A clamping device according to claim 1, wherein the supporting elements are supported on the clamping rail and are carried by a retaining member.

7. A clamping device according to claim 6, wherein said retaining member includes a first rack which has teeth and which is movable in the linear direction, and a second rack which has teeth and which is adjustable longitudinally in the clamping rail for moving the first rack in the linear direction, the teeth of the first rack messing with the teeth of the second rack.

8. A clamping device according to claim 7, wherein the second rack is connected to a drive means for moving the second rack longitudinally of the clamping rail.

9. A clamping device according to claim 8, including an adjusting arm connected to each support element, and a slide to which the adjusting arms are connected for pivoting the support elements about respective pivot axes.

10. A clamping device according to claim 1, including a spring surrounding each support element for spring biasing each thread contacting member away from the clamping rail.

* * * * *